United States Patent [19]

Hilton

[11] Patent Number: 4,842,280

[45] Date of Patent: Jun. 27, 1989

[54] SWING WEIGHT FOR GOLF CLUB IRON

[76] Inventor: Carol M. Hilton, 240 Cedar Ridge Dr., Glastonbury, Conn. 06033

[21] Appl. No.: 200,070

[22] Filed: May 27, 1988

[51] Int. Cl.[4] ..... A63B 69/36

[52] U.S. Cl. ..... 273/194 B; 273/DIG. 30

[58] Field of Search ..... 273/193 R, 194 R, 194 A, 273/194 B, 193 A, 186 A, 167 R, 72 R, 67 R, 67 A, 29 A, 167 F, 169–172, 162 R, 77 R, 26 R, 26 B, 73 R, DIG. 30; 272/96, 119, 67; 128/166, 25 B, DIG. 15; 150/52 G

[56] References Cited

U.S. PATENT DOCUMENTS 3,398,961 8/1968 Higdon ..... 273/194 B 4,556,215 12/1985 Tarbox et al. ..... 272/119

*Primary Examiner*—Edward M. Coven

*Assistant Examiner*—S. Passaniti

*Attorney, Agent, or Firm*—McCormick, Paulding & Huber

[57] ABSTRACT

A fabric envelope has two flat weights arranged symmetrically with respect to a center line that lies on the top edge of the golf club head. The envelope folds on this center line to orient the weights adjacent the front and rear faces of the club head. Attachment straps at the heel and toe secure the device to the club head so that the sole of the club head is not covered.

20 Claims, 2 Drawing Sheets

SWING WEIGHT FOR GOLF CLUB IRON

This invention relates generally to weighted attachments for golf clubs such as are commonly used by golfers to facilitate use of the golf club in preliminary exercising maneuvers. More particularly, this invention relates to a golf club swing weight attachment that is peculiarly designed for attachment to a conventional golf club iron.

Golf club swing weight devices have been provided in many forms, but generally such devices are adapted for use with golf club woods. Very few prior art devices disclose swing weights adapted for use with a golf club iron.

U.S. Pat. No. 3,398,961 issued to Higdon in 1968 does illustrate a weighted cover suitable for use with an iron type golf club. This prior art disclosure requires the user to spend some time in securing the weighted cover to the golf club by means of a shoe string or the like. This prior art disclosure also suffers from the disadvantage that the cover extends over the bottom or sole of the club, and therefore renders the cover susceptible to dragging on the ground during the normal exercising maneuvers followed by the typical golfer during his warming up program.

The present invention reduces significantly the time required for the golfer to attach the device to his iron, and also provides an improved design such that the need for providing a co er encircling all surfaces of the iron is not necessary. Further, the weight distribution of the device itself enhances that of the club head by providing a balanced weight distribution with weights provided on each side of the club head rather than on only one side as taught in the prior art Higdon patent.

In accordance with the present invention a golf club swing weight device has an envelope defined by inner and outer panels that are sewn together or otherwise secured, at least peripherally, to provide individual pockets for two trapezoidally shaped weights. Attachments straps of the hook and eye variety have projecting portions that are adapted to encirle the heel and/or the toe of the club head so that the device is secured to the golf club head with a center portion of the envelope lying on the top edge of the club head, and so that the bottom edge of the club head is not covered. This provides the user with freedom to swing the weighted club in a more normal manner so as to permit some contact with the ground during his warm up maneuvers without creating contact between the ground and the device itself.

DETAILED DESCRIPTION

Figure 1:
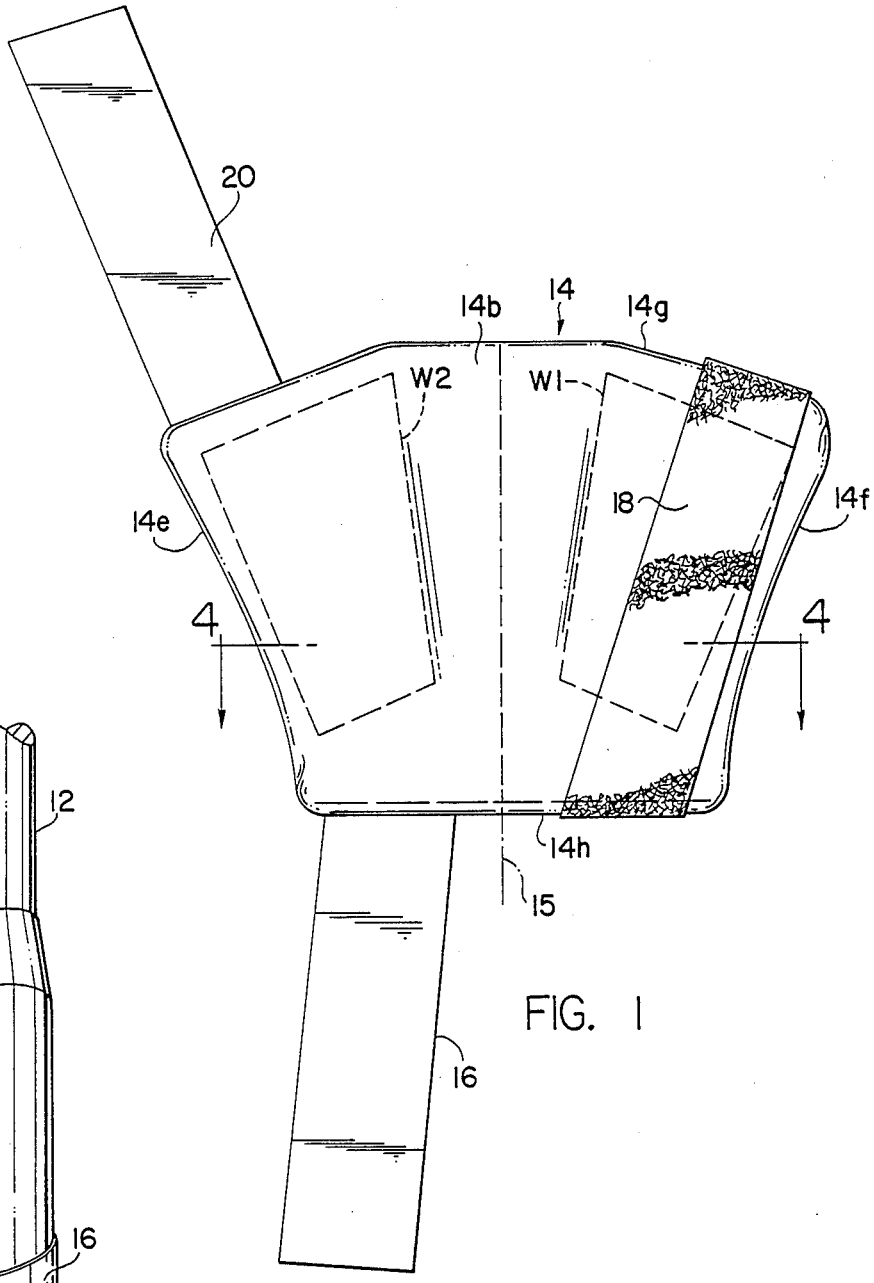
FIG. 1 is a plan view of a swing weight device constructed in accordance with the present invention, the device being layed flat in this view to better illustrate its geometrical configuration apart from the golf club.

Turning now to the drawings in greater detail, FIG. 1 illustrates a golf club swing weight device constructed in accordance with the present invention, and adapted to be attached to a golf club iron for purposes of exercising maneuvers with the golf club, including swinging of the club so that the sole of the iron's head can contact the ground without interference caused by the configuration of the swing weight device itself.

Figure 3:
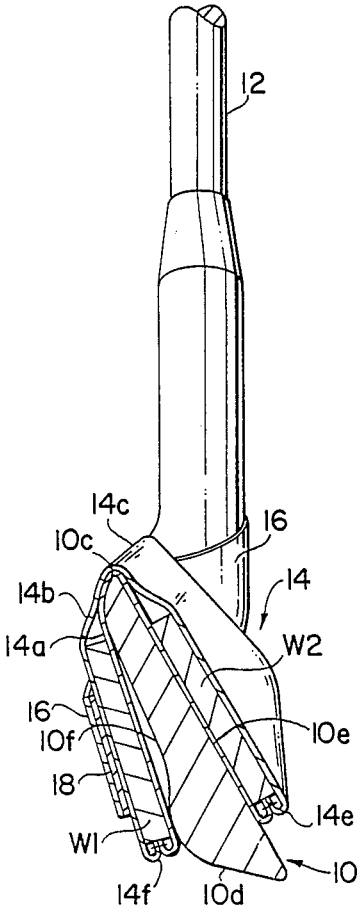
FIG. 3 is a vertical section taken generally on the line 3—3 of FIG. 2.
Figure 2:
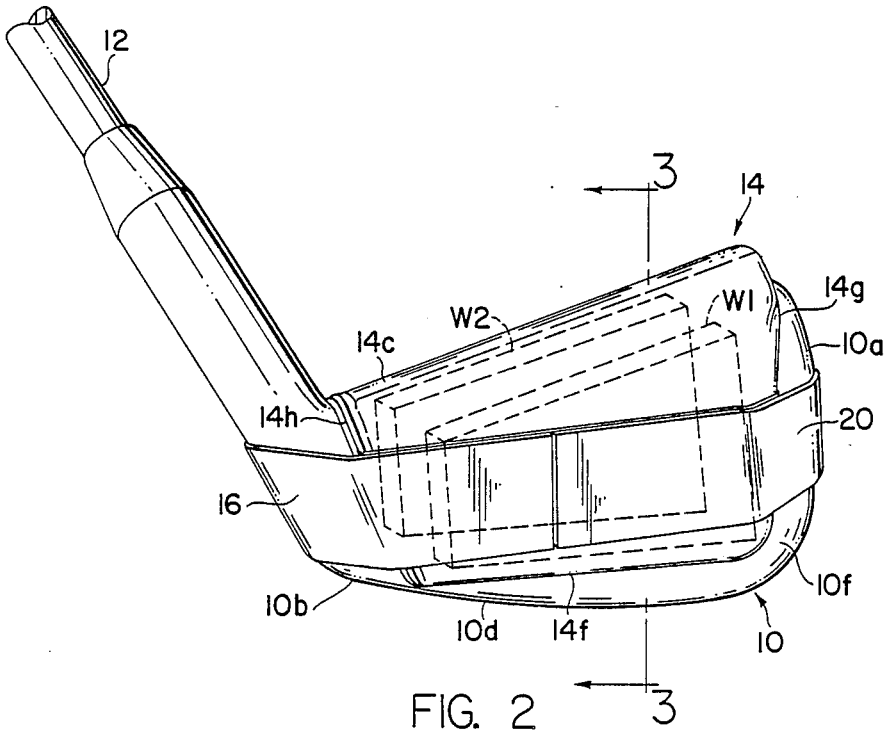
FIG. 2 is a perspective view of the golf club swing weight attached to a golf club iron.

FIG. 3 illustrates a conventional golf club iron having a head 10 and a shaft 12 connected to the head at the heel, and the head can be seen to include a toe 10*a* opposite the heel 10*b* the latter being illustrated in FIG. 2 as connected to the shaft 12 at the hosel.

Still with reference to the golf club iron, the head also includes a top edge 10*c* and a bottom edge or sole 10*d*. The sole 10*d* is adapted to lie generally flat or parallel to the ground during a normal golf swing, and the shaft 12 extends upwardly toward the golfer who will grip the handle (not shown) provided for this purpose at the upper end of the shaft 12. A conventional golf club iron has a top edge that is inclined relative to the bottom edge or sole 10*d* as best shown in FIG. 2. A right handed club is shown having the front or golf ball striking face 10*e* angled relative to the axis of the shaft 12 to provide a proper degree of loft for the club. The rear face 10*f* of the club head may be of any contour depending upon the golf club manufacturer's specifications and it is an important feature of the present invention that the swing weight to be described can be attached to most golf club irons of present day design.

In its presently preferred form the golf club swing weight device disclosed has two metal weights, each of which has a trapedozial configuration, provided symmetrically relative the center line 15 inside an envelope that serves to support the swing weights adjacent to the front and rear faces of the golf club iron head. FIG. 3 illustrates these weights, W1 and W2, provided adjacent the rear and the front faces, respectively, of the golf club iron described above.

Turning now to FIG. 1, the weights W1, W2 are illustrated with the envelope 14 in its open or layed flat configuration. This envelope or envelope means 14 comprises inner and outer panels 14*a*, 14*b* that are sewn together at least peripherally to provide pockets for the weights W1 and W2. A center portion 14*c* of the envelope has the panels 14*a* and 14*b* so arranged that they contact one another along center line 15 to provide a convenient center area or portion of the envelope means that permits the envelope 14 to be folded on this line 15. Thus, center portion, of line 15 lies generally along the top edge 10*c* of the the golf club head when the device is attached thereto.

The envelope or envelope means 14 has opposed edges 14*e* and 14*f* arranged generally symmetrically on either side of this center line 15, and these edges 14*e* and 14*f* are adapted to assume positions on the golf club head that are generally parallel to but slightly above the lower edge 10*d* of the head so as to expose the sole or lower edge 10*d* of the head and to avoid contact between the ground and the swing weight attachment device itself during the golfer's exercising maneuvers.

As shown in FIG. 1 the envelope 14 also includes edge portions 14*g* and 14*h* that are so spaced from one another as to assume positions adjacent to the toe 10*a* and heel 10*b* respectively of the golf club head, but again are preferably designed to expose these parts of the head. Preferably the top edge 10*c* of the head is the only edge that is covered by the envelope 14 when the device is attached to the golf club head as best shown in FIG. 2 and in FIG. 3.

Attachment means in the form of at least one flexible strap 16 is secured to the envelope means 14 such that a projecting portion of the strap extends away from the envelope generally parallel to the center line 15 referred to previously. As so constructed and arranged the strap 16 is adapted to encircle the heel of the golf club iron's head, and this projecting portion of the strap 16 is adapted to overlie and to contact means 18 for securing this strap free end portion 18. The strap securing means 18 is preferably located on the exterior surface of envelope 14 and more particularly one panel **14*b*, and adjacent the edge 14*f*** of the envelope.

A second strap 20 is preferably secured to the envelope and has a projecting portion extending away from the envelope in a direction generally opposite that of the first mentioned strap 16. As so constructed and arranged the second strap 20 is adapted to encircle the toe of the iron's head as best shown in FIG. 2. This strap also has a free end portion adapted for attachment to said means 18 on panel **14*b* of the envelope 14**.

The above mentioned straps 16 and 20, as well as the means 18 for securing these strap projecting portions to the outer panel **14*b*, preferably comprise interactive hook and eye fabric straps of the type currently sold under the trademark Velcro. Either the straps 16 and 20, or the strap securing means 18 may comprise the hooks or the eyes, and other equivalent attachment means might also be provided for securing the envelope 14 in the inverted U-shaped configuration over the head of a golf club iron as shown in FIGS. 2 and 3**.

The envelope or envelope means 14 preferably comprises a non-woven fabric of synthetic thermoplastic material such as vinyl, and may comprise a material currently sold under the trademark Naugahyde. However, other equivalent materials might be adapted for use and any inexpensive yet rugged material capable of being folded along the center line 15 to provide a central portion of the envelope in a draped position over the top edge **10*c*** of the club head will satisfy the basic criteria for positioning weights W1 and W2 in positions adjacent the front and rear faces of the golf club iron all as shown and described hereinabove.

Figure 4:
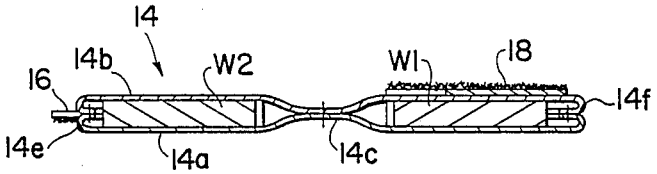
FIG. 4 is a section taken generally on the line 4—4 of FIG. 1.

As mentioned above the envelope 14 comprises inner and outer panels **14*a* and 14*b* preferably sewn or otherwise secured at least peripherally to one another, and preferably a major portion of the sewn joint or seam between these panels is hidden from view by being formed on the inside of the pocket defining portions thereof as suggested in FIG. 4. In the presently preferred embodiment the front and rear panels are fabricated from similar material but it is within the scope of the present invention to provide the outer panel 14*b* of a material that may itself define the hooks or eyes for providing the securing means for the strap projecting portions 16 and 20. It should also be noted that the outer panel 14*b* can be otherwise identified to facilitate the user in folding the envelope 14 in the proper direction and in a proper orientation to facilitate attaching the swing weight device to his golf club iron's head. For example, the outer panel fabric can be fabricated from a color different from that of the inner panel. In the sewn up version shown the panels are not only stitched peripherally, but are also joined along the line 15**. This serves to better define pockets for the weights W1 and W2. In lieu of stitching other means for securing the panels can be utilized. For example, sonic welding is suitable for joining synthetic panels of certain types of synthetic material. Still another envelope means within the scope of the invention might be fabricated from a thermoplastic material wherein the weights W1 and W2 are supported in a metal mesh or envelope skeleton structure, and the envelope is final formed by dipping the weights and the weight supporting structure in a molten thermoplastic bath that forms the final closed envelope means.

I claim:

1. A device for use with a golf club iron having a hosel and attached head with front and rear faces, and having top and bottom edges that extend from a toe to a heel of the iron's head, said device comprising:

envelope means having opposed envelope edges spaced symmetrically from a center line located between said opposed envelope edges, said envelope means being foldable at least along said central line, two metal weights provided inside said envelope means, each weight having one edge adjacent one of said opposed envelope edges, each weight having a second edge oriented generally parallel to and adjacent said envelope means central line, attachment means for securing said envelope means to the iron's head such that each weight is adjacent a face of the iron's head and such that the envelope means center line lies on the top edge of the iron's head, said attachment means including at least one flexible strap secured to said envelope means and having a projecting portion extending away from said envelope means generally parallel to said central line whereby said strap is adapted to encircle the heel of the iron's head, and means for securing said strap projecting portion of said envelope means.

2. The device according to claim 1 wherein said attachment means further includes a second strap secured to said envelope means and having a projecting portion extending away from said envelope means in a direction generally opposite that of said at least one strap projecting portion whereby said second strap is adapted to encircle the toe of the iron's head, and means for securing said second strap projecting portion to said envelope means.

3. The device according to claim 1 wherein said strap and said means for securing said strap comprise interactive hook and eye fabric materials.

4. The device according to claim 2 wherein said straps and means for securing said straps comprise interactive hook and eye fabric strap material.

5. The device according to claim 1 wherein said envelope means comprises a sheet material.

6. The device according to claim 5 wherein said sheet material is non-woven.

7. The device according to claim 5 wherein said sheet material is thermoplastic.

8. The device according to claim 1 wherein said envelope means comprises inner and outer panels, said inner and outer panels marginally secured to one another to provide pockets for said weights.

9. The device according to claim 8 wherein said panels comprise sheet material.

10. The device according to claim 9 wherein said sheet material is non-woven.

11. The device according to claim 9 wherein said sheet material is synthetic.

12. A swing weight for a golf iron having a head including front and rear faces, top and bottom surfaces, a toe and a heel, said swing weight comprising a unitary envelope made from flexible material and symmetrical about a central axis, said envelope having a pair or generally trapezoidal shaped sections integrally connected along said axis, each of said sections defining a closed compartment, a pair of generally trapezoidally shaped weights, each of said weights being received within an associated one of said compartments, at least one attaching strap, said strap being connected at one end of its ends to said envelope and having a free end, and means for attaching the free end of said strap to one of said envelope sections, said swing weight being attachable to an iron head with one of said envelope sections disposed adjacent the front face of the head and the other of said envelope sections adjacent the head rear face and with said axis generally overlying the head top surface, said strap encompassing a portion of the heel, said strap also overlying said one envelope section and said attaching means, said envelope sections in their attached positions having lower edges disposed above the lowermost edge of the bottom surface of the head whereby the lowermost edge of the bottom surface of the head is not covered either by the envelope or by the strap.

13. A swing weight as set forth in claim 12 wherein said attaching strap and attaching means comprises flexible strips of interactive hook and eye fabric material.

14. A swing weight as set forth in claim 13 further comprising a second strap connected at one of its ends to said envelope and having a free end, said second strap free end encompassing an associated portion of the toe of the head and said strap free end portion also attached to said one envelope section by said attachment means whereby said second strap is also free of the lowermost edge of the bottom edge of the club head.

15. The combination comprising a golf club iron having a hosel and attached head and swing weight envelope means, said head having a heel and a toe,said golf club head including front and rear faces, said golf club head including top and bottom edges, said edges extending from said toe to said heel of the head, said swing weight envelope means having opposed edges that are spaced from a center line located between said opposed edges, said swing weight being foldable along said center line and defining at least two pockets provided between the center line and the opposed edges, metal weights provided in said pockets, said weights each having one edge adjacent said opposed edges, and said weights further including second edges oriented in spaced relationship to one another and generally parallel said center line, and attachment means for securing said swing weight to said club head so that each weight is provided adjacent one of the said front and rear club faces, and so that said center line lies on the top edge of said club head whereby the said swing weight is provided with said opposed edges disposed above the bottom edge of said club head.

16. The combination according to claim 15 wherein said attachment means comprises at least one flexible strap secured to said swing weight and having a projecting portion extending generally parallel said center line, said strap encircling the heel of the club head, and means for securing said strap projecting portion to said swing weight.

17. The combination according to claim 16 wherein said attachment means further includes a second strap secured to said swing weight and having a projecting portion extending in a direction generally opposite that of said at least one strap projecting portion, said second strap encircling the toe of the club head, said means for securing said first strap projecting portion also securing said second strap projecting portion.

18. The combination according to claim 17 wherein said swing weight comprises an envelope fabricated from a thermoplastic non-woven material.

19. The combination according to claim 18 wherein said envelope comprises inner and outer panels, said inner and outer panels being marginally secured to one another to provide pockets for said weights.

20. The combination according to claim 19 wherein said inner and outer panels are secured to one another along at least a portion of said center line to restrain said weights in said pockets.

* * * * *